United States Patent [19]

Schick et al.

[11] 4,175,047

[45] Nov. 20, 1979

[54] SYNTHETIC ESTER AND HYDROGENATED OLEFIN OLIGOMER LUBRICANT AND METHOD OF REDUCING FUEL CONSUMPTION THEREWITH

[75] Inventors: John W. Schick, Cherry Hill; Joan M. Kaminski, Clementon, both of N.J.

[73] Assignee: Mobil Oil Corporation, New York, N.Y.

[21] Appl. No.: 945,282

[22] Filed: Sep. 25, 1978

[51] Int. Cl.[2] ..... C10M 1/26; C10M 3/20

[52] U.S. Cl. ..... 252/56 S; 252/59; 585/3; 585/10; 585/18; 184/1 E

[58] Field of Search ..... 252/56 S, 59

[56] References Cited

U.S. PATENT DOCUMENTS

| | | | |
|---|---|---|---|
| 2,798,083 | 7/1957 | Bell et al. | 260/410.6 |
| 2,820,014 | 1/1958 | Hartley et al. | 252/56 |
| 3,115,519 | 12/1963 | Crouse et al. | 260/488 |
| 3,235,498 | 2/1966 | Waldmann | 252/33.4 |
| 3,282,971 | 11/1966 | Metro et al. | 260/410.6 |
| 3,297,574 | 1/1967 | MacPhail et al. | 252/46.7 |
| 3,309,318 | 3/1967 | Aylesworth et al. | 252/56 |
| 3,763,244 | 10/1973 | Shubkin | 252/56 S |
| 3,780,128 | 12/1973 | Shubkin | 252/59 |
| 3,843,535 | 10/1974 | Denis et al. | 252/56 S |
| 3,860,522 | 1/1975 | Fischer et al. | 252/56 S |

*Primary Examiner*—Irving Vaughn

*Attorney, Agent, or Firm*—Charles A. Huggett; Raymond W. Barclay; Claude E. Setliff

[57] ABSTRACT

Synthetic esters or mixtures thereof, containing a free hydroxyl group in the molecule, are useful as lubricants for internal combustion engines, preferably in combination with synthetic hydrocarbon fluids. The composition, when used to lubricate an internal combustion engine, reduces the fuel consumed by such engine.

24 Claims, No Drawings

SYNTHETIC ESTER AND HYDROGENATED OLEFIN OLIGOMER LUBRICANT AND METHOD OF REDUCING FUEL CONSUMPTION THEREWITH

BACKGROUND OF THE INVENTION

1. Field of the Invention

The invention is concerned with synthetic ester lubricants. More particularly, it deals with synthetic ester lubricants containing a free hydroxyl, which ester lubricant is preferably combined with a synthetic hydrocarbon lubricating oil.

2. Discussion of the Prior Art

For several years there have been numerous efforts to reduce the amount of fuel consumed by automobile engines and the like. The search for ways to do this was given added impetus by the oil embargo. Many of the solutions have been strictly mechanical, as for example, setting the engine for a leaner burn or simply building smaller cars and smaller engines.

Other efforts have revolved around finding lubricants that reduce the overall friction in the engine, thus allowing a reduction in energy requirements thereto. A considerable amount of work has been done with mineral lubricating oils and greases, modifying them with additives to reduce their friction properties. On the other hand, new lubricants have been synthesized and compounded for use in modern engines. Among these is Mobil 1, a synthetic fluid which is known to reduce fuel consumption by a significant amount.

So far as is known, no effort has been made to employ hydroxyl-containing acid esters as a lubricant per se. U.S. Pat. No. 2,788,326 discloses some of the esters suitable for the present invention, e.g. glycerol monooleate, as minor components of lubricating oil compositions. U.S. Pat. No. 3,235,498 discloses, among others, the same ester as just mentioned, as an additive to other oils. U.S. Pat. No. 2,443,578 teaches esters wherein the free hydroxyl is found in the acid portion, as for example in tartaric acid.

It will be noted that the above patents, as well as numerous others, are directed to the use of such esters as additives. Other patents, such as U.S. Pat. Nos. 2,798,083; 2,820,014; 3,115,519; 3,282,971; and 3,309,318 as well as an article by R. S. Barnes et al. entitled "Synthetic Ester Lubricants" in Lubrication Engineering, August, 1957, pp. 454–457, teach lubricants prepared from polyhydric alcohols and acid containing no hydroxyl other than those associated with the acid function. However, all these references teach lubricants prepared from the fully esterified material.

SUMMARY OF THE INVENTION

The invention provides an organic fluid composition comprising a lubricating oil having from about 20% by weight to about 40% by weight of a hydroxyl-containing synthetic ester oil of lubricating viscosity, or mixtures thereof, and from about 60% by weight to about 80% by weight of a synthetic hydrocarbon lubricating oil consisting essentially of a hydrogenated oligomer of an alpha olefin having from 6 to 12 carbon atoms.

DESCRIPTION OF SPECIFIC EMBODIMENTS

It has been estimated that modern car weighing about 4300 pounds with 10:1 compression ratio and traveling at 40 mph on a level roadway has available for propelling it only 13.1% of the energy available in the gasoline burned. The losses are due primarily to fuel pumping, tare, friction, transmission, rear axle, tires, and wind resistance. The actual fuel used in propelling the vehicle amounts to about 16.7 mpg. If all fuel were used in propelling the vehicle, it could travel 128 miles on a gallon of gasoline.

Of the energy loss, approximately 5%, or 6.4, mpg, can be accounted for in loss due to lubricated engine components. Consequently, a mere 10% decrease in boundary and viscous friction would lead to a 3.8% increase in fuel economy (from 16.7 mpg to 17.3 mpg). It is little wonder, then, that energy companies are concerned with finding new lubricants or new additives that have superior lubricity properties.

As was mentioned hereinabove, one method of boosting fuel economy is to optimize the lubrication of the engine and drive train; that is, minimize friction losses between lubricating moving parts. The benefit of Mobil 1 over, for example, Mobil Super is better than 4%, attained solely by lowering of the viscous friction of the engine lubricant. Additional improvements may be realized by modification of the boundary friction of the lubricant.

The present invention minimizes such friction losses and thereby decreases fuel consumption for a given distance traveled by employing esters or mixtures thereof as lubricating components of lubricating oils. In this regard, it has been discovered that a particular class of esters is useful for the purpose. These contain a free hydroxyl group, derived either from the polyhydric alcohol or from the acid. When the alcohol is used as the source of free hydroxyl, it is necessary that the reaction mixture contain less acid then is stoichiometrically equivalent to the number of hydroxyls present in said alcohol. On the other hand, if the free hydroxyl is found in the acid, the alcohol may be fully reacted with the acid carboxyls.

Typical polyhydric alcohols (which term includes glycols, etc.) contemplated for use in this invention include those containing from 2 to 30 carbon atoms and from 2 to 6 hydroxyls. Specific numbers that may be mentioned are the alkylene glycols, particularly ethylene glycol and propylene glycol; the diglycols; glycerol; sorbitan; the trimethylolalkanes, such as trimethylolpropane; neopentyl glycol; pentaerythritol; dipentaerythritol; the polyalkyl alkane diols such as 2,2-dimethyl-3-isopropyl-1, 3-propanediol; and the like.

The acids useful as reactants with these alcohols include any monocarboxylic acid of the formula $$R—COOH$$

wherein R is a straight or branched chain alkyl group containing from 5 to 30 carbon atoms or mixtures thereof, but no alcoholic hydroxyl group. A particularly effective acid, or acid mixture, may be found among those having from 4 to 10 carbon atoms. Some of the acids that may be named are valeric, hexanoic (caproic), heptanoic, otanoic, nonanoic (pelagornic), decanoic (capric), pivalic (2,2-dimethylpropionic) acids and the like.

Among the esters contemplated are diglycol oleate, palmitate and stearate, glycerol monoricinoleate, monostearate, distearate, myristate and palmitate, propylene glycol monostearate, glycerol monooleate and dioleate, sorbitan monooleate and monolaurate, pentaerythritol mono-, di- and tributyrate esters, the mono-, di- and tricaproate esters, the mono-, di- and tri-esters wherein the acids are selected from mixed $C_5$–$C_{10}$ acids. Included also are the mono- and di-esters of trimethylolpropane and one of pivalic, valeric, caproic, heptanoic, octanoic and nonanoric acids or mixtures thereof, 2,2-diethyl-1,3-propanediol monopelargonate, and the like.

The hydroxyl-containing acid has the formula $$(HO)_xR—COOH$$

wherein R is an alkylene group having from 5 to 30 carbon atoms and x is from 1 to 5. Some of the hydroxyl-containing acids useful in the invention are tartaric acid, tartronic acid, lactic acid, citric acid, mucic acid, malic acid, hydroxy-butyric acid and glycolic acid. Any of the alcohols mentioned above can be used (in which case the alcohol may be partially or fully esterified) or a monohydric alcohol containing from 4 to 22 carbon atoms can be employed. Examples of such alcohols are butyl, amyl, octyl, decyl, dodecyl, hexadecyl, stearyl, oleyl, and the like.

Among the hydroxyl-containing acids contemplated are the butyl and dibutyl lactates, tributyl citrate, diisostearyl tartrate, dioleyl malate, dioleyl tartrate, di-2-ethylhexyl malate, glycerol trimalate (glycerol plus 3 moles of malic acid), glycol ditartrate, and the like.

As has been stated the ester lubricant component of this invention can be made up of a single ester or it can include two or more esters. Such a mixture can contain from about 5% to about 95% by weight of any other ester, the others being selected such that they together comprise from about 95% to about 5% by weight.

The lubricant of this invention will comprise from about 60% by weight to about 80% of a synthetic hydrocarbon oil of lubricating viscosity. Useful in practicing the invention is a class of hydrogenated oligomers obtained from alpha olefins containing from 6 to 12 carbon atoms, as described in U.S. Pat. Nos. 3,382,291, 3,149,178 and 3,725,498. Preference is accorded hydrogenated oligomers of decene-1, octene-1 and mixtures thereof, with the decene-1 being particularly preferred.

Typical properties of a hydrogenated alpha decene oligomer (trimer) and a mixed alpha decene/octene oligomer are shown in Table 1.

TABLE 1

| | Decene Oligomer | Decene/octene (85/15 Wt. %) Oligomer |
|---|---|---|
| API Gravity | 39.4 | 39.8 |
| Kinematic Viscosity | | |
| at 210° F. cSt | 5.7 | 5.8 |
| at 100° F. cSt | 30 | 29 |
| at −40° F. cSt | 7000 | 6800 |
| Viscosity Index | 145 | 135 |
| Pour Point, °F. | −65 | −80 |
| Flash Point, °F. | 450 | 440 |
| Dimer Content, Wt. % | 0.35 | 0.30 |

The lubricant can contain additives to impart various other properties thereto. For example, it can contain antioxidant, load carrying agent, anti-wear agent and the like, either alone or in combination.

Having described the invention broadly, the following will specifically illustrate same.

EXAMPLE 1

This Example illustrates an ester containing no free hydroxyl group.

The desired molar ratio of glycol and carboxylic acid was heated in the presence of a catalytic amount of p-toluene sulfonic acid (i.e. 0.1% of the combined weight of glycol and carboxylic acid) at a temperature of 245° C. Water was simultaneously removed, and the reaction was continued until an acid number of less than 1 was obtained. The partial ester was filtered before formulation into the oil.

EXAMPLES 2–16

These esters were prepared substantially as described in Example 1.

In preparing the esters of the Examples, the reactants are merely heated together at from about 160° C. to about 240° C. for from 3 to 6 hours, both depending upon the acid and the alcohol chosen.

Table 2 contains the molar ratios of acids and alcohols used in synthesizing the various esters studied, as well as the viscosities of the esters at 40° and 100° C.

TABLE 2

EFFECT OF ESTER STRUCTURE ON PHYSICAL PROPERTIES

| | Molar Ratios | | | | # of Free | Kinematic Viscosity, cs | | |
|---|---|---|---|---|---|---|---|---|
| Example | PE | TMP | Oleic Acid | Pelargonic Acid | —OH Groups/ Mole | 40° C. | 100° C. | VI |
| 1 | 1 | 0 | 4 | 0 | 0 | 69.6 | 12.75 | 186 |
| 2 | 1 | 0 | 3 | 0 | 1 | 82.50 | 13.24 | 162 |
| 3 | 1 | 0 | 1 | 2 | 1 | 55.31 | 9.23 | 149 |
| 4 | 1 | 0 | 0 | 3 | 1 | 43.72 | 7.043 | 120 |
| 5 | 1 | 0 | 0.5 | 2 | 1.5 | 76.25 | 10.17 | 116 |
| 6 | 1 | 0 | 2 | 0 | 2 | 142.3 | 16.76 | 127 |
| 7 | 1 | 0 | 1.5 | 0.5 | 2 | 135.5 | 16.23 | 127 |
| 8 | 1 | 0 | 1 | 1 | 2 | 129.4 | 14.61 | 114 |
| 9 | 1 | 0 | 0.5 | 1.5 | 2 | 129.1 | 12.82 | 91 |
| 10 | 1 | 0 | 0 | 2 | 2 | 101.9 | 10.66 | 85 |
| 11 | 0 | 1 | 0 | 2.5[a] | 0.5 | 21.04 | 4.375 | 118 |
| 12 | 0 | 1 | 1.25 | 1.25 | 0.5 | 35.21 | 7.035 | 167 |
| 13 | 0 | 1 | 0 | 2 | 1 | 23.13 | 4.505 | 106 |
| 14 | 0 | 1 | 0.5 | 1.5 | 1 | 33.01 | 6.004 | 129 |
| 15 | 0 | 1 | 1 | 1 | 1 | 39.96 | 7.189 | 144 |
| 16[b] | 0 | 1 | 0 | 3[a] | 0 | 20.49 | 4.37 | 136 |
| 50:50 ester 6:ester 16 | | | | | | 44.34 | 7.991 | 154 |
| 25:75 ester 6:ester 16 | | | | | | 28.87 | 5.93 | 156 |

[a] $C_8/C_{10}$ (15:85) Acid

[b] Viscosities measured at 100° and 210° F.

EVALUATION OF THE PRODUCTS

The esters were tested in the Low Velocity Friction Apparatus (LVFA).

The Low Velocity Friction Apparatus (LVFA) is used to measure the coefficient of friction of test lubricants under various loads, temperatures, and sliding speeds. The LVFA consists of a flat SAE 1020 steel surface (diam. 1.5 in.) which is attached to a drive shaft and rotated over a stationary, raised, narrow ringed SAE 1020 steel surface (area 0.08 in.$^2$). Both surfaces are submerged in the test lubricant. Friction between the steel surfaces is measured as a function of the sliding speed at a lubricant temperature of 250° F. The friction between the rubbing surfaces is measured using a torque arm-strain gauge system. The strain gauge output, which is calibrated to be equal to the coefficient of friction, is fed to the Y axis of an X-Y plotter. The speed signal from the tachometer-generator is fed to the X-axis. To minimize external friction, the piston is supported by an air bearing. The normal force loading the rubbing surfaces is regulated by air pressure on the bottom of the piston. The drive system consists of an infinitely variable-speed hydraulic transmission driven by a ½ HP electric motor. To vary the sliding speed, the output speed of the transmission is regulated by a lower-cam-motor arrangement.

PROCEDURE

The rubber surfaces and 12–13 ml of test lubricants are placed on the LVFA. A 240 psi load is applied, and the sliding speed is maintained at 40 fpm at ambient temperature for a few minutes. A plot of coefficients of friction ($U_k$) over the range of sliding speeds, 5 to 40 fpm (25–195 rpm), is obtained. A minimum of three measurements is obtained for each test lubricant. Then, the test lubricant and specimens are heated to 250° F., another set of measurements is obtained, and the system is run for 50 min. at 250° F., 240 psi, and 40 fpm sliding speed. Afterward, measurements of $U_k$ vs. speed are taken at 240, 300, 400, and 500 psi. Freshly polished steel specimens are used for each run. The surface of the steel is parallel ground to 2 to 4 microinches.

Table 3 summarizes viscosities and results for laboratory tests using the LVFA.

TABLE 3

PROPERTIES OF FORMULATED SYNTHETIC OILS[1]

| Formulated with Ester of Example | KV (cs) 40° C. | at 100° C. | VI | % Reduction in Coefficient of Friction[a] 5 Ft./Min. | 30 Ft./Min. |
|---|---|---|---|---|---|
| 1 | | | | −3.5 | 2 |
| | | | | 6 | 9 |
| 2 | 56.03 | 8.795 | 134 | 19 | 13 |
| | | | | 21 | 14 |
| 3 | | | | 13 | 8 |
| 4 | | | | 11 | 4 |
| 5 | 55.93 | 8.941 | 138 | 18 | 31 |
| | | | | 21 | 14 |
| 6 | 56.01 | 9.057 | 141 | 28 | 24 |
| | | | | 31 | 24 |
| | | | | 23 | 17 |
| 7 | 50.5 | 8.167 | 134 | 27 | 23 |
| | | | | 23 | 25 |
| 8 | 50.74 | 8.629 | 148 | 23 | 12 |
| | | | | 19 | 21 |
| 9 | | insoluble in oil | | insoluble in oil | |
| 10 | | insoluble in oil | | insoluble in oil | |
| 11 | | | | 8 | 8 |
| 12 | | | | 8 | 8 |
| 13 | | | | 2 | −2 |

TABLE 3-continued

PROPERTIES OF FORMULATED SYNTHETIC OILS[1]

| Formulated with Ester of Example | KV (cs) 40° C. | at 100° C. | VI | % Reduction in Coefficient of Friction[a] 5 Ft./Min. | 30 Ft./Min. |
|---|---|---|---|---|---|
| 14 | | | | 13 | 10 |
| 15 | 43.58 | 7.496 | 139 | 11 | 14 |
| | | | | 8 | 7 |
| | | | | 13 | 13 |
| | | | | 11 | 15 |
| 16[b] | 40.27 | 6.85 | 140 | 0 | 0 |
| 50:50 ester 6:ester 16 | 43.25 | 7.777 | 151 | 22 | 13 |
| 25:75 ester 6:ester 16 | 39.45 | 7.31 | 152 | 12 | 10 |

[1]The oil was a blend of 80% by weight of decene trimer and 20% by weight of the indicated ester. The total formulation contained 85% by weight of this oil and 15% by weight of an additive package containing an antioxidant, an antiwear agent and a dispersant detergent.
[a]LVFA results at 250° F. and 500 psi.
[b]Viscosities measured at 100° and 210° F.

| Engine Description | |
|---|---|
| 1977 302 CID Ford engine with following characteristics | |
| Bore, in. | 4.0 |
| Stroke, in. | 3.0 |
| Displacement cu. in. | 302 |
| Cylinder Arrangement | V8; 90° |
| Compression Ratio | 8.4:1 |
| Spark Plugs | ARF 52, Gap 0.048–.052 |
| Ignition | Transitorized |
| Carburetor | 2 Bbl. |

| Operating Conditions | |
|---|---|
| RPM | 1200 |
| Coolant Temperature, °F. | 190 ± 2 |
| Test Time, Min. | 20 |

| Auxiliary Equipment | |
|---|---|
| Fuel Meter | Fluidyne 1250 |
| Dynamometer | GE 400 HP at 6000 RPM |
| Oil Change/Supply System | 5 gal. tanks |

TEST PROCEDURE

The engine oil sump and oil change/supply system are connected through three-way valves. Once the engine is in operation, lubricants, whether reference or experimental, can be exchanged without engine shutdown. Prior to testing an experimental lubricant, the engine is normally brought to its operating conditions with the reference oil (e.g. Mobil Super or Mobil 1), the engine RPM is set at 1200 and series of fuel consumption runs made until repeatable values are obtained. The reference lubricant is now exchanged for the experimental lubricant. Any change in engine operating conditions are adjusted. For example, with friction modified oils, the RPM's actually increase somewhat above the standard 1200 setting indicating a freer movement of engine parts due to less friction. Before any fuel consumption measurements are made, the carburetor setting is manually adjusted to reduce the RPM level back to the standard 1200. Once stabilized, the full meter is activated and the fuel consumption is less. The reverse condition in which there is engine drag will give negative effect. The percent fuel economy is calculated after correction for temperature-fuel density changes as follows:

$$\% \text{ Fuel Economy} = \frac{\text{Fuel Consumption (Reference)} - \text{Fuel Consumption (Experimental)}}{\text{Fuel Consumption (Reference)}} \times 100$$

REPEATABILITY

The repeatability of the test at 95% confidence level is ±0.15%. Thus, differences in fuel consumption of greater than 0.30% between oils are significant at 95% confidence level.

TABLE 4

Evaluation of Formulated Synthetic Oils[1] on Ford 302 CID Engine

| Formulated with Ester of Example | % Fuel Savings |
|---|---|
| 2 | 0.6 |
| 5 | 0.7 |
| 6 | 0.5 |
| 7 | 0.5 |
| 8 | 0.6 |
| 15 | 0.85 |

[1]See note (1), Table 3.

We claim:

1. An organic fluid composition comprising a lubricating oil having from about 20% by weight to about 40% by weight of a hydroxyl-containing synthetic ester oil, or mixtures thereof, and from about 60% by weight to about 80% by weight of a synthetic hydrocarbon lubricating oil consisting essentially of a hydrogenated oligomer of an alpha olefin having from 6 to 12 carbon atoms.

2. The composition of claim 1 wherein the ester oil is made by reacting (1) a monocarboxylic acid, of the formula $$R—COOH$$

wherein R is a $C_5$–$C_{30}$ alkyl group, or mixtures of such acids with (2) a polyhydric alcohol.

3. The composition of claim 1 wherein the ester oil is made by reacting (1) a monocarboxylic acid of the formula $$(HO)_xR—COOH$$

wherein R is an alkylene group containing from 5 to 30 carbon atoms and x is from 1 to 5 with (2) a polyhydric alcohol or a monohydric alcohol.

4. The composition of claim 2 wherein the lubricating oil is a mixture of 80% by weight of hydrogenated decene trimer and 20% by weight of said ester oil.

5. The composition of claim 2 wherein the polyhydric alcohol has from 2 to 30 carbon atoms and from 2 to 6 hydroxyl groups.

6. The composition of claim 3 wherein the polyhydric alcohol has from 2 to 30 carbon atoms and from 2 to 6 hydroxyl groups and the monohydric alcohol contains from 4 to 22 carbon atoms.

7. The composition of claim 2 wherein the ester oil is made by reacting 1 mole of pentaerythritol with 3 moles of oleic acid.

8. The composition of claim 2 wherein the ester oil is made by reacting 1 mole of pentaerythritol with a mixture of 0.5 mole of oleic acid and 2 moles of pelargonic acid.

9. The composition of claim 2 wherein the ester oil is made by reacting 1 mole of pentaerythritol with 2 moles of oleic acid.

10. The composition of claim 2 wherein the ester oil is made by reacting 1 mole of pentaerythritol with a mixture of 1.5 moles of oleic acid and 0.5 mole of pelargonic acid.

11. The composition of claim 2 wherein the ester oil is made by reacting 1 mole of pentaerythritol with a mixture of 1 mole of oleic acid and 1 mole of pelargonic acid.

12. The composition of claim 2 wherein the ester oil is made by reacting 1 mole of trimethylolpropane with a mixture of 1 mole of oleic acid and 1 mole of pelargonic acid.

13. A method of decreasing fuel consumption in an internal combustion engine by lubricating said engine with an organic fluid composition comprising a lubricating oil having from about 20% by weight to about 40% by weight of a hydroxyl-containing synthetic ester oil, or mixtures thereof, and from about 60% by weight to about 80% by weight of a synthetic hydrocarbon lubricating oil consisting essentially of a hydrogenated oligomer of an alpha olefin having from 6 to 12 carbon atoms.

14. The method of claim 13 wherein the ester oil used is made by reacting (1) a monocarboxylic acid, of the formula $$R—COOH$$

wherein R is a $C_5$–$C_{30}$ alkyl group, or mixtures of such acids with (2) a polyhydric alcohol.

15. The method of claim 13 wherein the ester oil used is made by reacting (1) a monocarboxylic acid of the formula $$(HO)_xR—COOH$$

wherein R is an alkylene group containing from 5 to 30 carbon atoms and x is from 1 to 5 with (2) a polyhydric alcohol or a monohydric alcohol.

16. The method of claim 14 wherein the lubricating oil is a mixture of 80% by weight of hydrogenated decene trimer and 20% by weight of said ester oil.

17. The method of claim 14 wherein the polyhydric alcohol has from 2 to 30 carbon atoms and from 2 to 6 hydroxyl groups.

18. The method of claim 15 wherein the polyhydric alcohol has from 2 to 30 carbon atoms and from 2 to 6 hydroxyl groups and the monohydric alcohol contains from 4 to 22 carbon atoms.

19. The method of claim 14 wherein the ester oil used is made by reacting 1 mole of pentaerythritol with 3 moles of oleic acid.

20. The method of claim 14 wherein th ester oil used is made by reacting 1 mole of pentaerythritol with a mixture of 0.5 mole of oleic acid and 2 moles of pelargonic acid.

21. The method of claim 14 wherein the ester oil used is made by reacting 1 mole of pentaerythritol with 2 moles of oleic acid.

22. The method of claim 14 wherein the ester oil used is made by reacting 1 mole of pentaerythritol with a mixture of 1.5 moles of oleic acid and 0.5 mole of pelargonic acid.

23. The method of claim 14 wherein the ester oil used is made by reacting 1 mole of pentaerythritol with a mixture of 1 mole of oleic acid and 1 mole of pelargonic acid.

24. The method of claim 14 wherein the ester oil used is made by reacting 1 mole of trimethylolpropane with a mixture of 1 mole of oleic acid and 1 mole of pelargonic acid.

* * * * *

UNITED STATES PATENT AND TRADEMARK OFFICE

CERTIFICATE OF CORRECTION

PATENT NO. : 4,175,047

DATED : November 20, 1979

INVENTOR(S) : John W. Schick and Joan M. Kaminski

It is certified that error appears in the above-identified patent and that said Letters Patent are hereby corrected as shown below:

Column 3, line 30, "other" should read --one--.

Signed and Sealed this

*Eighth* Day of *April 1980*

[SEAL]

*Attest:*

SIDNEY A. DIAMOND

*Attesting Officer*

*Commissioner of Patents and Trademarks*